US012528574B2

(12) United States Patent
Nojiri

(10) Patent No.: US 12,528,574 B2
(45) Date of Patent: Jan. 20, 2026

(54) COLLISION DAMAGE REDUCTION SYSTEM FOR WATERCRAFTS

(71) Applicant: HONDA MOTOR CO., LTD., Tokyo (JP)

(72) Inventor: Daisuke Nojiri, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 489 days.

(21) Appl. No.: 18/154,343

(22) Filed: Jan. 13, 2023

(65) Prior Publication Data

US 2023/0227141 A1 Jul. 20, 2023

(30) Foreign Application Priority Data

Jan. 17, 2022 (JP) ..... 2022-004940

(51) Int. Cl.
*B63H 25/04* (2006.01)
*B63B 49/00* (2006.01)

(52) U.S. Cl.
CPC ..... *B63H 25/04* (2013.01); *B63B 49/00* (2013.01); *B63B 2213/02* (2013.01); *B63H 2025/045* (2013.01)

(58) Field of Classification Search
CPC ..... B63H 25/04; B63H 2025/045; B63H 2020/003; B63H 20/12; B63B 49/00; B63B 2213/02; B63B 43/18; Y02A 30/30
See application file for complete search history.

(56) References Cited

U.S. PATENT DOCUMENTS

| | | | | |
|---|---|---|---|---|
| 11,915,595 | B2 * | 2/2024 | Tomita | B63H 25/383 |
| 2017/0284808 | A1 * | 10/2017 | Saito | B63B 49/00 |
| 2017/0285645 | A1 | 10/2017 | Nakagawa | |
| 2023/0406461 | A1 * | 12/2023 | Uoshita | B63B 49/00 |

FOREIGN PATENT DOCUMENTS

| | | | | |
|---|---|---|---|---|
| ES | 2324971 | A1 * | 8/2009 | G08G 3/02 |
| JP | 2016049903 | A | 4/2016 | |
| JP | 2017178242 | A | 10/2017 | |

OTHER PUBLICATIONS

ES_2324971 Translation (Year: 2009).*

* cited by examiner

*Primary Examiner* — Brian P Wolcott
(74) *Attorney, Agent, or Firm* — Armstrong Teasdale LLP

(57) ABSTRACT

[Problem] To provide a collision damage reduction system for watercrafts, which system is usable even when a user watercraft stops or is moving at slow speed.
[Solution] A collision damage reduction system for watercrafts comprises: an information acquiring device for acquiring information on a user watercraft 2 and a target watercraft 11; a turning device for turning the user watercraft 2 to change a front-rear direction thereof; and a control device configured to acquire the information from the information acquiring device, and control the turning device based on the acquired information. When detecting a risk of collision between the user watercraft 2 and the target watercraft 11, the control device controls the turning device such that the turning device turns the user watercraft 2 to a state in which the front-rear direction thereof is parallel to a moving direction of the target watercraft 11.

6 Claims, 5 Drawing Sheets

COLLISION DAMAGE REDUCTION SYSTEM FOR WATERCRAFTS

TECHNICAL FIELD

The present invention relates to a collision damage reduction system for avoiding a collision between a user watercraft (i.e., a watercraft using the system) and a target watercraft (i.e., a different watercraft that may involve a risk of collision with the user watercraft) or for reducing collision damage of the watercrafts in a collision therebetween, even when the user watercraft stops or is moving at slow speed.

BACKGROUND ART

Various technologies have been developed for avoiding a collision between a moving watercraft and an obstacle. An example of such technologies is a watercraft steering system configured such that, when an obstacle detector detects an obstacle for a user watercraft, i.e., a watercraft using the system, a travel speed of the user watercraft is automatically changed so as to avoid collision between the user watercraft and the obstacle (Patent Document 1). Another example is a navigational assistance device for watercraft, the device comprising a calculation unit configured such that, when detecting a risk of collision between a user watercraft that uses the device, and a target watercraft based on outputs from a radar-based detection device, the calculation unit selects a navigation command for navigational assistance to avoid collision with the target watercraft; and a display unit for indicating the selected navigation command (Patent Document 2).

PRIOR ART DOCUMENT(S)

Patent Document(s)

Patent Document 1: JP2017-178242A
Patent Document 2: JP2016-049903A

SUMMARY OF THE INVENTION

Task to be Accomplished by the Invention

However, the system disclosed in Patent Document 1 further requires taking into consideration the risk of secondary collision with other obstacles such as watercrafts or shore in the travel direction selected for collision avoidance. In particular, when a plurality of watercrafts are anchored or moving at slow speed near the user watercraft, the system needs to take further steps to avoid such secondary collisions by using a sensing device capable of detecting obstacles around the user watercraft with high accuracy, which makes the system more expensive and complicated. The navigational assistance device disclosed in Patent Document 2 can work only when a user is operating a user watercraft and can see a navigation command on the display. Thus, when a user watercraft is at anchor or in harbor and the user cannot see a screen on the display, the device is unable to achieve the intended technical effect.

The present invention has been made in view of the above-described problems of the prior art, and a primary object of the present invention is to provide a collision damage reduction system for watercrafts, which can be used by a user watercraft that stops or is moving at slow speed and reduce collision damage of the user watercraft in a collision between the user watercraft and a different watercraft.

Means to Accomplish the Task

An aspect of the present invention provides a collision damage reduction system 1 for watercrafts, comprising: an information acquiring device 9 for acquiring information used to determine a watercraft speed of a user watercraft 2 that is a watercraft using the system, a distance between the user watercraft 2 and a target watercraft 11 that is a different watercraft from the user watercraft, a moving direction of the target watercraft 11 with respect to the user watercraft 2, a relative speed of the target watercraft 11 with respect to the user watercraft 2, and a heading direction of the user watercraft 2 with respect to the moving direction of the target watercraft 11; a turning device 10 for turning the user watercraft 2 to change a front-rear direction thereof; and a control device 7 configured to acquire the information from the information acquiring device 9, and control the turning device 10, wherein, when detecting a risky state of the user watercraft 2 in which the watercraft speed is equal to or less than a predetermined value and there is a risk of collision between the user watercraft 2 and the target watercraft 11, the control device 7 controls the turning device 10 such that the turning device 10 turns the user watercraft 2 to a parallel state in which the front-rear direction of the user watercraft 2 is parallel to the moving direction of the target watercraft 11.

According to this configuration, when a collision may occur between the user watercraft and the target watercraft, the system turns the user watercraft to a parallel state in which the front-rear direction of the user watercraft is parallel to the moving direction of the target watercraft, thereby minimizing the area occupied by the user watercraft in a plane perpendicular to the moving direction of the target watercraft, which reduces the risk of collision between the user watercraft and the target watercraft. In addition, even when a collision occurs between the user watercraft and the target watercraft, the user watercraft slides over the target watercraft where the force of impact is dispersed over the surface of the target watercraft and partially absorbed by a movement of thereof, which reduces the collision impact to the user watercraft, protects persons aboard the user watercraft and reduces collision damage of the user watercraft. Furthermore, as the system only turns the user watercraft so that the front-rear direction of the user watercraft is parallel to the moving direction of the target watercraft, a movement of the user watercraft for collision avoidance requires only a small area, which reduces a risk of collision with another obstacle such as watercraft which might occur as a result of the movement of the user watercraft for collision avoidance. Also, the total cost required to set up a collision damage reduction system of this configuration is lower than a system that requires taking into consideration other obstacles such as watercrafts in determining the travel direction for collision avoidance.

The above system may be further configured such that, when the user watercraft 2 is turned to the parallel state, a front part of the user watercraft 2 is directed to the side of the target watercraft 11.

In this configuration, even when a collision occurs between the user watercraft and the target watercraft, the user watercraft slides over the target watercraft where the force of impact is dispersed over the surface of the target watercraft and partially absorbed by a movement of thereof, which reduces the collision impact to the user watercraft, protects persons aboard the user watercraft and reduces collision damage of the user watercraft. In this configuration, as the front part of the user watercraft is directed to the side of the target watercraft, a crew member of the user watercraft can easily notice the target watercraft.

The above system may be further configured such that, upon detecting the risky state, the control device 7 controls the turning device 10 such that, when the target watercraft 11 is on the left side of the user watercraft 2, the turning device 10 turns the user watercraft 2 counterclockwise, and that, when the target watercraft 11 is on the right side of the user watercraft 2, the turning device 10 turns the user watercraft 2 clockwise.

In this configuration, as the system determines the turning direction based on the position of the target watercraft relative to that of the user watercraft, the user watercraft can be turned to the parallel state in a short period of time.

The above system may be further configured such that the front part of the user watercraft 2 has a width which is tapered off frontward, as seen in a plan view, wherein, after the control device 7 detects the risky state and causes the turning device 10 to turn the user watercraft 2 to the parallel state, when determining that the user watercraft 2 is still in the risky state, the control device 7 controls the turning device 10 such that the heading direction of the user watercraft is displaced from the direction toward a front of the target watercraft 11.

In this configuration, the user watercraft is turned such that the heading direction of the user watercraft is displaced from the direction toward the front of the target watercraft. Thus, when a collision occurs, the user watercraft slides over the target watercraft where the force of impact is dispersed over the surface of the target watercraft and partially absorbed by a movement of thereof, which reduces the collision impact to the user watercraft, protects persons aboard the user watercraft and reduces collision damage of the user watercraft.

The above system may be further configured such that the turning device 10 comprises a single outboard motor 6, wherein the outboard motor 6 includes an upper part 15 configured to be attached to the user watercraft 2, and a lower part 16 configured to be rotatable with respect to the upper part 15 about an axis extending vertically, wherein the lower part 16 is provided with a propeller 13 for providing propulsion to the user watercraft 2, and wherein the turning device 10 turns the user watercraft 2 by operating the propeller to provide propulsion to the user watercraft 2 in a traverse direction of the user watercraft 2.

In this configuration, as the outboard motor for providing propulsion to the user watercraft is utilized as a turning device, to set up a collision damage reduction system requires lower cost. In addition, as the user watercraft is turned to the parallel state substantially at the same place, this configuration reduces a risk of collision with another obstacle such as watercraft which might occur as a result of the movement of the user watercraft for collision avoidance.

The above system may be further configured such that the turning device 10 comprises two outboard motors 6 attached to the user watercraft, and wherein the turning device 10 turns the user watercraft 2 by operating one outboard motor 6 to provide frontward propulsion to the user watercraft 2, concurrently with operating the other outboard motor 6 to provide reverse propulsion to the user watercraft 2.

In this configuration, as the outboard motors for providing propulsion to the user watercraft are utilized as a turning device, to set up a collision damage reduction system requires lower cost. In addition, as the user watercraft is turned to the parallel state substantially at the same place, this configuration reduces a risk of collision with another obstacle such as watercraft which might occur as a result of the movement of the user watercraft for collision avoidance.

Effect of the Invention

As described above, the present invention can provide a collision damage reduction system for watercrafts, which can be used by a user watercraft that stops or is moving at slow speed and reduce collision damage of watercrafts in a collision between the user watercraft and a different watercraft.

DESCRIPTION OF THE PREFERRED EMBODIMENT(S)

In the following, embodiments of the present invention will be described in detail with reference to the drawings.

Figure 1:
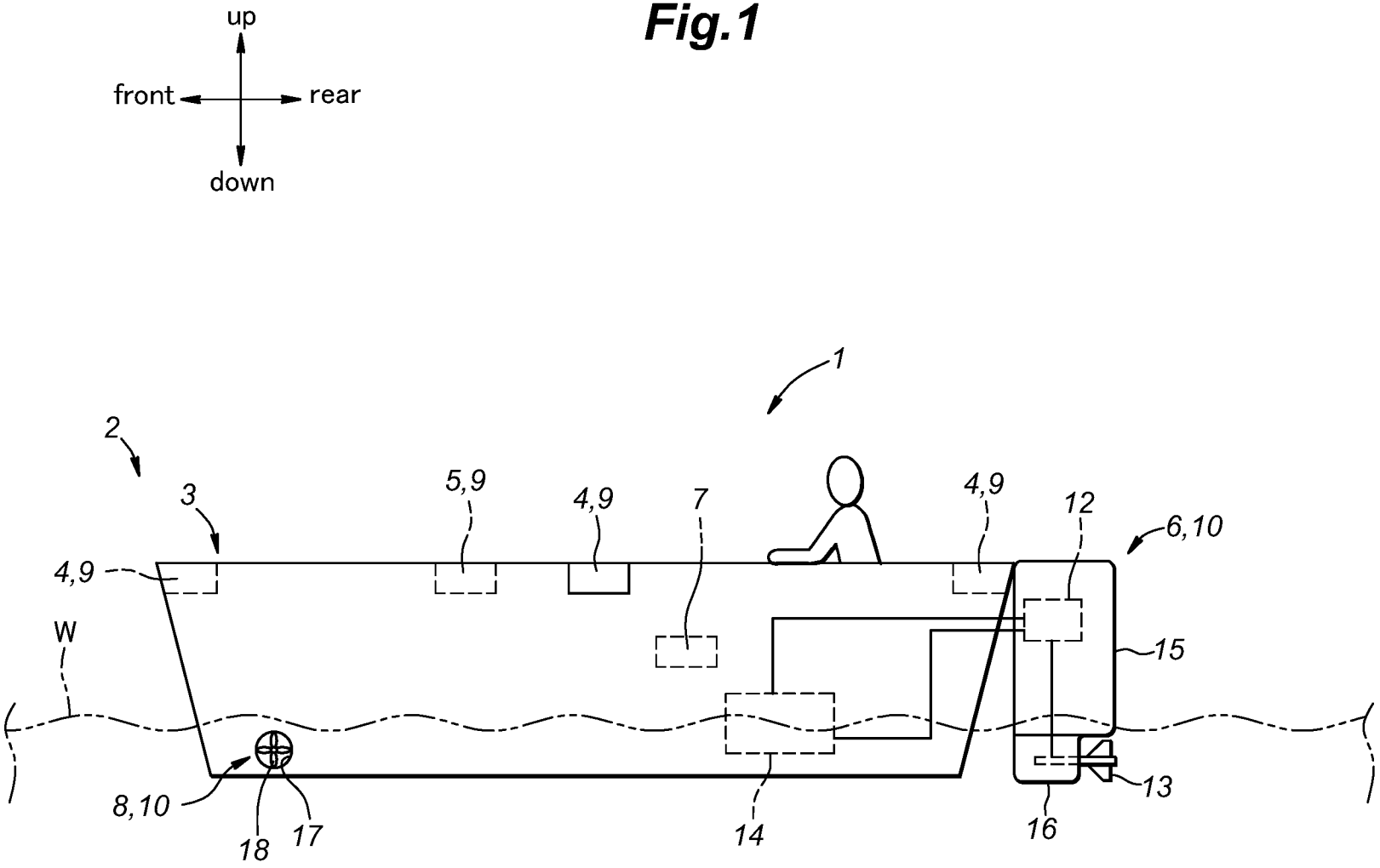
FIG. 1 is a schematic side view of a user watercraft; that is, a watercraft equipped with a collision damage reduction system according to an embodiment of the present invention.
Figure 2:
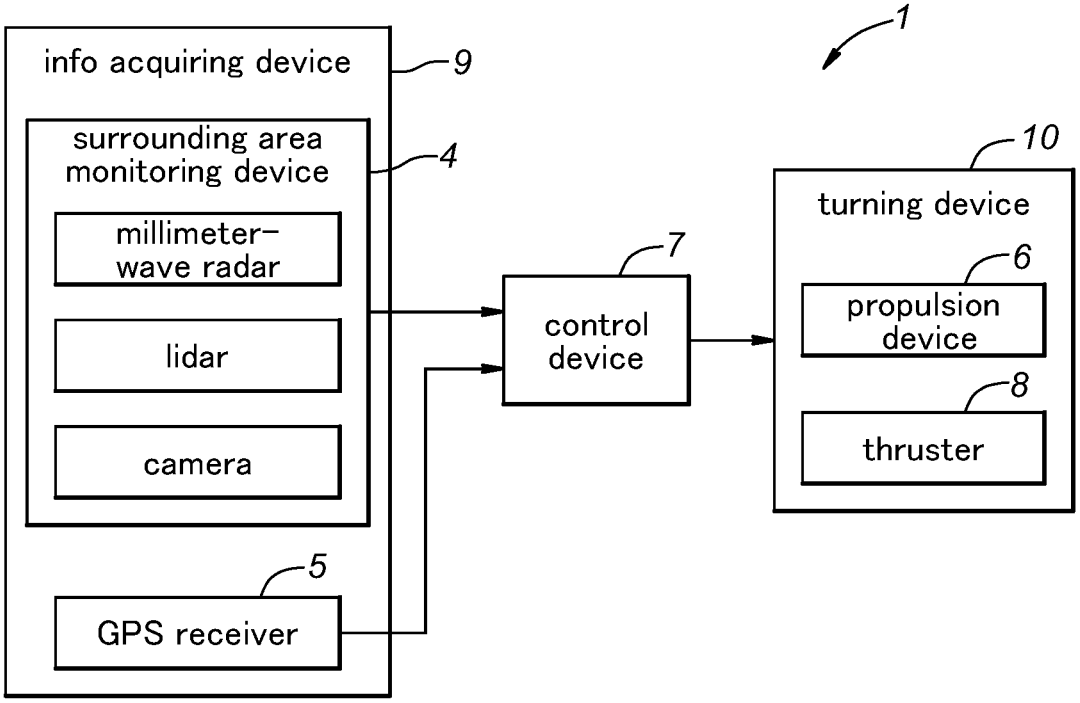
FIG. 2 is a block diagram of a collision damage reduction system according to an embodiment of the present invention.

FIG. 1 is a schematic side view of a user watercraft 2; that is, a watercraft equipped with a collision damage reduction system 1 according to an embodiment of the present invention. Examples of the user watercraft 2 include, but not limited to, a small watercraft such as a pleasure boat or a fishing boat. The user watercraft 2 includes: a hull 3 extending in a front-rear direction of the user watercraft 2; a plurality of surrounding area monitoring devices 4 located at the front, back, left and right of the hull 3; a GPS receiver 5 installed in the hull 3; a propulsion device 6 attached to the rear of the hull 3; and a control device 7 provided in the hull 3 or within the propulsion device 6. The user watercraft 2 may further include a thruster(s) 8. As shown in FIG. 2, the collision damage reduction system 1 includes: an information acquiring device 9 including a surrounding area monitoring device 4 and a GPS receiver 5; a turning device 10 including a propulsion device(s) 6 and/or a thruster(s) 8; a control device 7 communicatively coupled to the information acquiring device 9 and the turning device 10 so that the control device 7 can transmit and receive signals to and from the devices through wired or wireless connections.

As shown in FIG. 1, the hull 3 is the main body of the user watercraft 2 with a front part having a width which is tapered off frontward, as seen in a plan view (See FIG. 3).

The surrounding area monitoring devices 4 include a millimeter-wave radar, a lidar and/or cameras. A surrounding area monitoring device 4 acquires information including the direction toward and the distance from an obstacle such as another watercraft, i.e., a target watercraft 11 (see FIG. 3) for the user watercraft 2 and transmits the acquired information to the control device 7.

The GPS receiver 5 receives signals from artificial satellites (positioning satellites), acquires information including the position data (latitude and longitude) of the user watercraft 2 based on the received signals, and transmits the acquired information to the control device 7.

The propulsion device 6 is an outboard motor that is detachably attached to the hull 3, and includes an electric motor 12 as a drive power source, and a propeller 13 located below the water line W and configured to be rotated by the electric motor 12 to provide propulsion to the user watercraft 2. The propulsion device 6 may be an inboard motor or an inboard/outboard motor that is permanently attached to the hull 3. The propulsion device 6 may include an internal combustion engine as a drive power source, instead of or in addition to the electric motor 12. The electric motor 12 is connected to a battery 14 mounted on the hull 3 and rotated by power supplied from the battery 14.

When the propulsion device 6 is an outboard motor, the device includes an upper part 15 attached to the hull 3 and a lower part 16 including a propeller 13. When the propulsion device 6 is a single outboard motor, the lower part 16 is rotatable with respect to the upper part 15 about an axis extending vertically. When the outboard motor provides frontward propulsion to the user watercraft 2, the lower part 16 is rotated about the axis and positioned at such a rotational angle (with respect to the upper part 15) that the propeller 13 faces rearward of the user watercraft 2 and rotates. When the outboard motor is used to turn the user watercraft 2, the lower part 16 is rotated about the axis to be positioned at a rotational angle at which the propeller 13 faces in a transverse direction of the user watercraft 2 and rotates.

When the propulsion device 6 includes two outboard motors attached to the rear of the hull 3 side by side, the lower part 16 does not need to be rotatable with respect to the upper part 15, and the propeller 13 of each outboard motor may always face rearward of the user watercraft 2. When the propeller 13 of each outboard motor rotates in the forward rotational direction, the propeller 13 provides frontward propulsion to the user watercraft 2, and when rotating in the reverse rotational direction, the propeller 13 provides reverse propulsion to the user watercraft 2. When the propulsion device 6 is used to turn the user watercraft 2, one outboard motor is operated to provide frontward propulsion to the user watercraft 2 while the other outboard motor is operated to provide reverse propulsion to the user watercraft 2.

The thruster 8 is provided in the front part of the hull 3 at a position under the water line W, and includes a tunnel 17 extending through the hull 3 in the left-right direction, and a propeller 18 installed within the tunnel 17. When being rotated, the propeller 18 generates a sideways water flow to turn the user watercraft 2. When the user watercraft 2 is provided with a thruster 8, the user watercraft 2 may be turned by the thruster 8 alone, or by a combination of the thruster 8 and the propulsion device 6.

As shown in FIG. 2, the control device 7 receives information from the information acquiring device 9 and controls the turning device 10 based on the received information. The control device 7 is comprised primarily of an electronic control unit (ECU) including a CPU, a nonvolatile memory (ROM), a volatile memory (RAM), and other components. The control device 7 controls the turning device 10 by the CUP executing processing operations according to programs. The control device 7 may be configured as one piece of hardware, or a combination of separate hardware units. Each functional unit of the control device 7 may be at least partially implemented by a hardware component such as LSI, ASIC, or FPGA, and/or a combination of software programs and hardware components.

Based on the information received from the information acquiring device 9, the control device 7 determines (i) the speed of the user watercraft 2 (hereafter also referred to as "user watercraft speed"), (ii) the distance between the user watercraft 2 and the target watercraft 11 (see FIG. 3), (iii) the moving direction of the target watercraft 11 with respect to the user watercraft 2, (iv) the relative speed of the target watercraft 11 with respect to the user watercraft 2, and (v) the heading direction of the user watercraft 2 with respect to the moving direction of the target watercraft 11. In some embodiments, the control device 7 may determine the user watercraft speed based on temporal change in the position of the user watercraft 2 acquired from the GPS receiver 5, or by using the Doppler frequency shift of each of the carrier waves of GPS signals from the satellites. In some cases, the control device 7 may determine a measurement measured by the surrounding area monitoring device 4 as the distance between the user watercraft 2 and the target watercraft 11. In other cases, the control device 7 determines the moving direction and the relative speed of the target watercraft 11 with respect to the user watercraft 2, respectively, based on temporal change in the distance between the user watercraft 2 and the target watercraft 11 measured by the surrounding area monitoring device 4. For example, the control device 7 may determine the heading direction of the user watercraft 2 with respect to the moving direction of the target watercraft 11 based on (i) the differences in distance from the target watercraft 11 measured by a plurality of surrounding area monitoring devices 4 (millimeter-wave radar, lidar), (ii) the attached positions of these surrounding area monitoring devices 4 in the user watercraft, and (iii) the moving direction of the target watercraft 11 (which has been determined separately). In some embodiments, the control device 7 may determine the heading direction of the user watercraft 2 with respect to the moving direction of the target watercraft 11 based on images of the target watercraft 11 captured by a surrounding area monitoring device 4 (camera). In some cases, when the control device 7 is capable of acquiring GPS data of the target watercraft 11 through a wireless communication path or other communication paths, the control device 7 may determine the distance between the user watercraft 2 and the target watercraft 11 based on information on the respective positions of the user watercraft 2 and the target watercraft 11, and then determine the moving direction and the relative speed of the target watercraft 11 with respect to the user watercraft 2, respectively, based on the acquired information on the positions and their temporal changes.

FIGS. 3 and 4 are explanatory diagrams showing how a user watercraft 2 moves, where the user watercraft 2 is equipped with a collision damage reduction system 1 of an embodiment of the present invention. In each case shown in FIGS. 3 and 4, a user watercraft 2 and a target watercraft 11 are schematically shown as pentagons, where, in each pentagon, lines extending parallel to each other represent two sides of the user watercraft 2 or target watercraft 11, and a tapered part corresponds to a front part thereof. In FIGS. 3 and 4, each open arrow indicates a moving direction of a target watercraft 11, and each black arrow indicates a moving (turning) direction of a user watercraft 2.

Figure 3A:
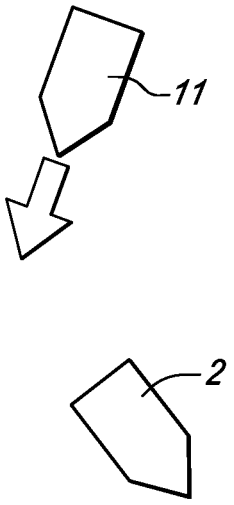
FIGS. 3A to 3C (collectively "FIG. 3") are explanatory diagrams showing how a user watercraft is turned by a collision damage reduction system of an embodiment of the present invention.
Figure 3B:
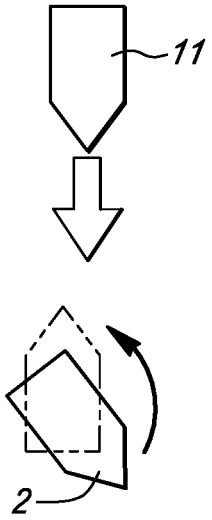
Figure 3C:
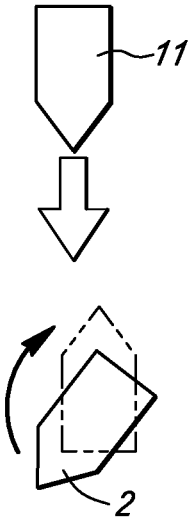

In each case, a user watercraft 2 stops or is moving at slow speed. The term "slow speed" means, for example, a speed of 5 km/h or less, preferably 1 km/h or less. FIG. 3A shows a case where there is no risk of collision between a user watercraft 2 and a target watercraft 11 as long as the target watercraft 11 moves in the same direction. In this case, the system does not turn the user watercraft 2. FIGS. 3B and 3C show cases where there is a risk of collision between a user watercraft 2 and a target watercraft 11 when the target watercraft 11 moves in the same direction. In either case, the system turns the user watercraft 2 to a state in which the front-rear direction of the user watercraft 2 is parallel to the moving direction of the target watercraft 11 and the heading direction of the user watercraft 2 is directed to the side of the approaching target watercraft 11. The direction in which the user watercraft 2 is turned is determined such that the angle of turn of the user watercraft 2 is 180° or less. Specifically, when the target watercraft 11 is on the left side of the user watercraft 2, the system turns the user watercraft 2 counterclockwise, as shown in FIG. 3B, whereas, when the target watercraft 11 is on the right side of the user watercraft 2, the system turns the user watercraft 2 clockwise, as shown in FIG. 3C.

Figure 4A:
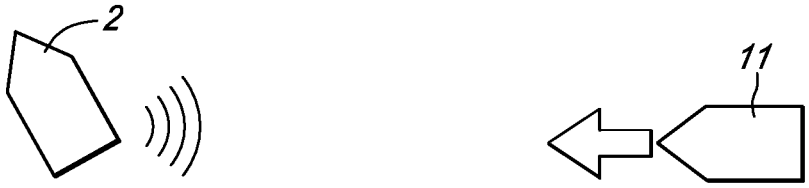
FIGS. 4A to 4D (collectively "FIG. 4") are explanatory diagrams showing how a user watercraft is operated by a collision damage reduction system of an embodiment of the present invention.
Figure 4B:
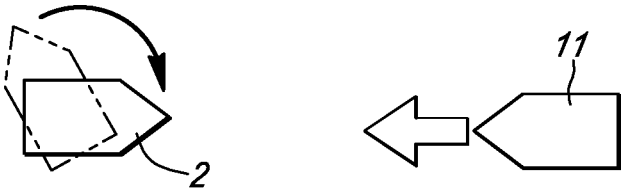
Figure 4C:
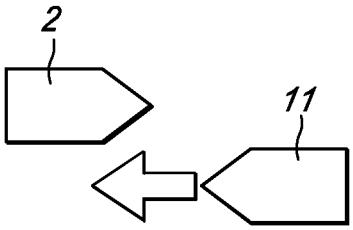
Figure 4D:
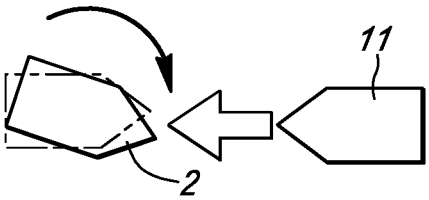
Figure 5:
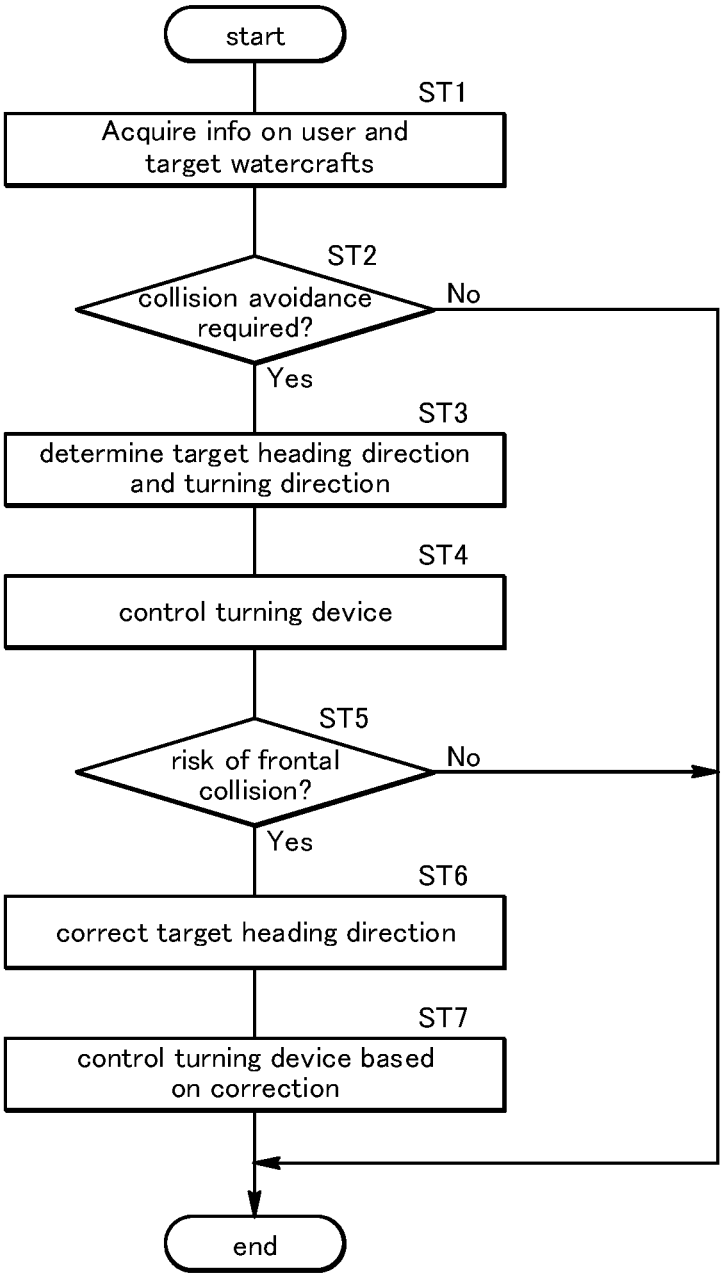
FIG. 5 is a flow chart showing a procedure of control operations performed by a control device of a collision damage reduction system according to an embodiment of the present invention.

FIG. 5 is a flow chart showing a procedure of control operations performed by the control device 7. A sequence of control operations performed by the control device 7 will be described with reference to FIGS. 2, 4 and 5.

The control device 7 acquires information on a user watercraft 2 and a target watercraft 11 from the information acquiring device 9. Then, based on the acquired information, the control device 7 determines (i) the user watercraft speed, (ii) the distance between the user watercraft 2 and the target watercraft 11, (iii) the moving direction of the target watercraft 11 with respect to the user watercraft 2, (iv) the relative speed of the target watercraft 11 with respect to the user watercraft 2, and (v) the heading direction of the user watercraft 2 with respect to the moving direction of the target watercraft 11 (ST1). Information transmitted from the information acquiring device 9 to the control device 7 is frequently updated, and preferably, the latest information is used when the control device 7 performs operations for the above-described determination of various values such as speed and operations of subsequent determinations as described below.

Next, the control device 7 determines whether or not the user watercraft speed is equal to or less than a predetermined value (i.e., the user watercraft 2 stops or is moving at slow speed) and there is a risk of collision between the user watercraft 2 and the target watercraft 11. (ST2, FIG. 4A). One example of the state in which there is a risk of collision between the user watercraft 2 and the target watercraft 11 is a case where, when the moving directions and speeds of the user watercraft 2 and the target watercraft 11 are not changed, collision is expected to occur between the target watercraft 11 and the user watercraft 2 within a predetermined time. When the user watercraft speed is greater than the predetermined value, or when there is no risk of collision between the user watercraft 2 and the target watercraft 11, the control device 7 ends the sequence of control operations.

When determining that the user watercraft speed is equal to or less than the predetermined value and there is a risk of collision between the user watercraft 2 and the target watercraft 11, the control device 7 determines the target heading direction of the user watercraft 2 and the turning direction (counterclockwise or clockwise) (ST3). Then, based on the results of determination, the control device 7 controls the turning device 10 such that the turning device 10 turns the user watercraft 2 (ST4, FIG. 4B). The target heading direction of the user watercraft 2 is a direction such that the front-rear direction of the user watercraft 2 is parallel to the moving direction of the target watercraft 11 and that the heading direction of the user watercraft 2 is directed to the side of the approaching target watercraft 11. The turning direction is selected such that, when the target watercraft 11 is on the left side of the user watercraft 2, the user watercraft 2 is turned counterclockwise, as shown in FIG. 3B, and when the target watercraft 11 is on the right side of the user watercraft 2, the user watercraft 2 is turned clockwise, as shown in FIG. 3C. When the user watercraft 2 is moving at slow speed, the control device 7 may stop the user watercraft 2 while turning the user watercraft 2.

Next, after turning the user watercraft 2 to the target heading direction, the control device 7 determines whether or not there is a risk of frontal collision between the user watercraft 2 and the target watercraft 11 (ST5). When there is no risk of frontal collision between the watercrafts, the control device 7 ends the sequence of control operations (FIG. 4C).

When there is a risk of frontal collision between the user watercraft 2 and the target watercraft 11, the control device 7 corrects the target heading direction of the user watercraft 2 so that the heading direction of the user watercraft 2 is displaced from the direction toward a front part of the target watercraft 11 (ST6), and turns the user watercraft 2 to the corrected target heading direction (ST7, FIG. 4D).

The operations and effects of the collision damage reduction system 1 will be described below in detail.

When there is a risk of collision between the user watercraft 2 and the target watercraft 11, the system turns the user watercraft 2 to a parallel state in which the front-rear direction of the user watercraft 2 is parallel to the moving direction of the target watercraft 11, thereby minimizing the area occupied by the user watercraft 2 in a plane perpendicular to the moving direction of the target watercraft 11, which reduces the risk of collision between the user watercraft 2 and the target watercraft 11. Even when a collision occurs between the user watercraft 2 and the target watercraft 11, the user watercraft 2 slides over the target watercraft 11 where the force of impact is dispersed over the surface of the target watercraft 11 and partially absorbed by a movement of thereof, which reduces the collision impact to the user watercraft 2, protects persons aboard the user watercraft 2 and reduces collision damage of the user watercraft 2. In particular, when there is a risk of frontal collision between the user watercraft 2 and the target watercraft 11, since the heading direction of the user watercraft 2 is displaced from the direction toward the front part of the target watercraft 11, the effect becomes significant.

In addition, the user watercraft 2 is turned to the parallel state substantially at the same place, which reduces a risk of collision with another obstacle such as watercraft (not shown) which might occur as a result of the movement of the user watercraft 2 for collision avoidance. Moreover, as the user watercraft 2 is turned to change the moving direction thereof, the system is preferably used by a user watercraft 2 that stops or is moving at slow speed. Furthermore, as the surrounding area monitoring device 4 of this collision damage reduction system requires lower accuracy than that of a system of the prior art configured to navigate a user watercraft 2 so as to avoid, in addition to a collision with the target watercraft 11, a secondary collision with an obstacle such as another watercraft, the total cost required to set up this system is lower than such a system of the prior art. Also, the turning movement of the user watercraft 2 is made slowly due to large water resistance, which means that, even when the user watercraft 2 collides with another watercraft located nearby during the turning movement, the collision causes less damage to the user watercraft 2 than other cases in which a user watercraft 2 is moved in its front-rear direction for collision avoidance.

Another advantage of this system is that, since the front part of the user watercraft 2 faces to the side of the approaching target watercraft 11, a crew member of the user watercraft 2 can easily notice the approach of the target watercraft 11.

Yet another advantage of this system is that, as the turning direction of the user watercraft 2 is determined based on the position of the target watercraft 11 relative to that of the user watercraft 2, the user watercraft 2 can be turned to the parallel state, in which the front-rear direction of the user watercraft 2 is parallel to the moving direction of the target watercraft 11, in a short period of time.

When the propulsion device 6 is a single outboard motor and thus the lower part 16 is rotatable with respect to the upper part 15 about an axis extending vertically, or when the propulsion device 6 includes two outboard motors attached to the rear of the hull 3 side by side, the propulsion device 6 can be also used as the turning device 10, which reduces the total cost required to set up a collision damage reduction system 1.

Generally, the front of a small watercraft tilts upwards when the watercraft is moving frontward. Thus, when the user watercraft 2 is small one and starts a sudden frontward movement for collision avoidance, persons aboard are likely to fall backward due to the tilted watercraft and the inertial force acting on them. As the collision damage reduction system 1 turns the user watercraft 2 substantially at the same place, the turning movement of the user watercraft 2 is made slowly due to large water resistance, resulting in a smaller tilt angle and less inertial force acting on persons aboard than the case of frontward movement, which prevents persons aboard from falling on the user watercraft 2.

Specific embodiments of the present disclosure are described herein for illustrative purposes. However, the present disclosure is not limited to those specific embodiments, and various modifications may be made to the embodiments without departing from the scope of the present disclosure. For example, when the user watercraft 2 is turned to reach the parallel state, the front part of the user watercraft 2 may be directed to the opposite direction to the side of the approaching target watercraft 11. In this case, when a crew member of the user watercraft 2 notices the approaching target watercraft 11 and operates the user watercraft 2 to move frontward, the user watercraft 2 moves away from the target watercraft 11, which makes it easy to achieve collision avoidance. In other embodiments, when the user watercraft 2 is turned, the control device 7 may, instead of turning the user watercraft 2 to the parallel state, turn the user watercraft 2 to a non-parallel state in which the front-rear direction of the user watercraft 2 is directed toward the target watercraft 11.

Glossary

1 collision damage reduction system
2 user watercraft
4 surrounding area monitoring device
5 GPS receiver
6 propulsion device (outboard motor)
7 control device
9 information acquiring device
10 turning device
11 target watercraft
13 propeller
15 upper part
16 lower part
W water line

The invention claimed is:

1. A collision damage reduction system for watercrafts, comprising:

an information acquiring device including a surrounding area monitoring device and a GPS receiver, the surrounding area monitoring device including a millimeter-wave radar, a lidar, and/or cameras;

a turning device, which is attached to a user watercraft that is a watercraft using the system, for turning the user watercraft to change a front-rear direction thereof, the turning device including a propulsion device, the propulsion device comprising single or two outboard motor(s)/engine(s), inboard motor(s)/engine(s) or inboard/outboard motor(s)/engine(s), each motor/engine including a propeller; and a control device which is including CPU and a memory, the control device configured to acquire the information from the information acquiring device, and control the turning device, wherein, the control device is configured to determine, based on the information received from the information acquiring device, a watercraft speed of the user watercraft, a distance between the user watercraft and a target watercraft that is a different watercraft from the user watercraft, a moving direction of the target watercraft with respect to the user watercraft, a relative speed of the target watercraft with respect to the user watercraft, and a heading direction of the user watercraft with respect to the moving direction of the target watercraft, when the moving direction of the target watercraft with respect to the user watercraft and the relative speed of the target watercraft with respect to the user watercraft are not changed and thereby collision is expected to occur between the target watercraft and the user watercraft within a predetermined time, the control device determines that there is a risk of collision between the user watercraft and the target watercraft, and when detecting a risky state of the user watercraft in which the watercraft speed is equal to or less than a predetermined value and there is the risk of collision between the user watercraft and the target watercraft, the control device controls a direction of the propeller with respect to the user watercraft, or a forward or reverse rotational direction of each propeller, such that the turning device turns the user watercraft to a parallel state in which the front-rear direction of the user watercraft is parallel to the moving direction of the target watercraft.

2. The system as in claim 1, wherein, when the user watercraft is turned to the parallel state, a front part of the user watercraft is directed to the side of the target watercraft.

3. The system as in claim 2, wherein, upon detecting the risky state, the control device controls the turning device such that, when the target watercraft is on the left side of the user watercraft, the turning device turns the user watercraft counterclockwise, and that, when the target watercraft is on the right side of the user watercraft, the turning device turns the user watercraft clockwise.

4. The system as in claim 2, wherein the front part of the user watercraft has a width which is tapered off frontward, as seen in a plan view, wherein, after the control device detects the risky state and causes the turning device to turn the user watercraft to the parallel state, when determining that the user watercraft is still in the risky state, the control device controls the turning device such that the heading direction of the user watercraft is displaced from the direction toward a front of the target watercraft.

5. The system as in claim 1, wherein the turning device comprises the single outboard motor/engine, wherein the single outboard motor/engine includes an upper part configured to be attached to the user watercraft, and a lower part configured to be rotatable with respect to the upper part about an axis extending vertically, wherein the lower part is provided with a propeller for providing propulsion to the user watercraft, and wherein the turning device turns the user watercraft by operating the propeller to provide propulsion to the user watercraft in a traverse direction of the user watercraft.

6. The system as in claim 1, wherein the turning device comprises the two outboard motors/engines attached to the user watercraft, and wherein the turning device turns the user watercraft by operating one outboard motor/engine to provide frontward propulsion to the user watercraft, concurrently with operating the other outboard motor/engine to provide reverse propulsion to the user watercraft.

* * * * *